US012123123B2

(12) United States Patent
Zamarreno et al.

(10) Patent No.: US 12,123,123 B2
(45) Date of Patent: Oct. 22, 2024

(54) DEVICE FOR DOSING A DETERGENT INGREDIENT INTO THE DRUM OF AN AUTOMATIC WASHING MACHINE

(71) Applicant: The Procter & Gamble Company, Cincinnati, OH (US)

(72) Inventors: Carlos Amador Zamarreno, Newcastle-upon-Tyne (GB); Paul Gould, Newcastle-upon-Tyne (GB); Michael Leslie Groombridge, Newcastle upon Tyne (GB); Ahmad Khattab, Meldreth (GB); Craig Nelson, Baldock (GB); Michael David Sawford, Northamptonshire (GB); William Frank Tyldesley, Norfolk (GB)

(73) Assignee: The Procter & Gamble Company, Cincinnati, OH (US)

( * ) Notice: Subject to any disclaimer, the term of this patent is extended or adjusted under 35 U.S.C. 154(b) by 268 days.

(21) Appl. No.: 17/745,987

(22) Filed: May 17, 2022

(65) Prior Publication Data

US 2022/0372683 A1 Nov. 24, 2022

(30) Foreign Application Priority Data

May 18, 2021 (EP) ..... 21174524

(51) Int. Cl.

| | |
|---|---|
| ***D06F 33/37*** | (2020.01) |
| ***D06F 39/02*** | (2006.01) |
| *D06F 105/42* | (2020.01) |

(52) U.S. Cl.
CPC ..... *D06F 33/37* (2020.02); *D06F 39/02* (2013.01); *D06F 2105/42* (2020.02)

(58) Field of Classification Search
None
See application file for complete search history.

(56) References Cited

U.S. PATENT DOCUMENTS

| | | | | |
|---|---|---|---|---|
| 4,981,024 | A | 1/1991 | Beldham | |
| 2014/0157836 | A1* | 6/2014 | Zattin | D06F 39/028 68/17 R |
| 2017/0037559 | A1* | 2/2017 | Gallagher | D06F 39/022 |
| 2019/0352830 | A1 | 11/2019 | Rupnow | |

FOREIGN PATENT DOCUMENTS

| | | | |
|---|---|---|---|
| DE | 102007041643 | A1 | 3/2009 |
| EP | 0196398 | A2 | 10/1986 |
| EP | 3502335 | A1 | 6/2019 |
| JP | 2008515568 | A | 5/2008 |
| WO | 2020227039 | A1 | 11/2020 |

OTHER PUBLICATIONS

Extended European Search Report and Search Opinion; Application No. 21174524.5; dated Nov. 10, 2021; 09 pages.
PCT Search Report and Written Opinion for PCT/US2022/028437 dated Jul. 25, 2022, 12 pages.

* cited by examiner

*Primary Examiner* — Cristi J Tate-Sims
(74) *Attorney, Agent, or Firm* — Carrie Schwartz; George H. Leal

(57) ABSTRACT

A device for dosing a detergent ingredient into the drum of an automatic washing machine which can include a reservoir, a one-way valve, an inlet, and a dosing manifold.

13 Claims, 3 Drawing Sheets

Figure 2: Example 1
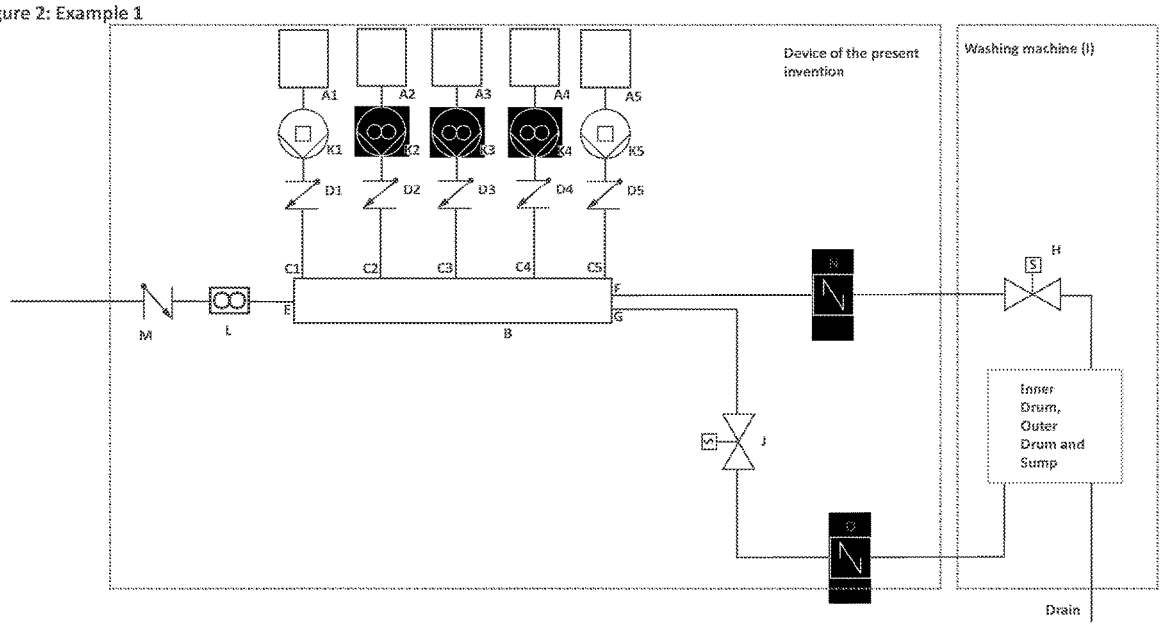

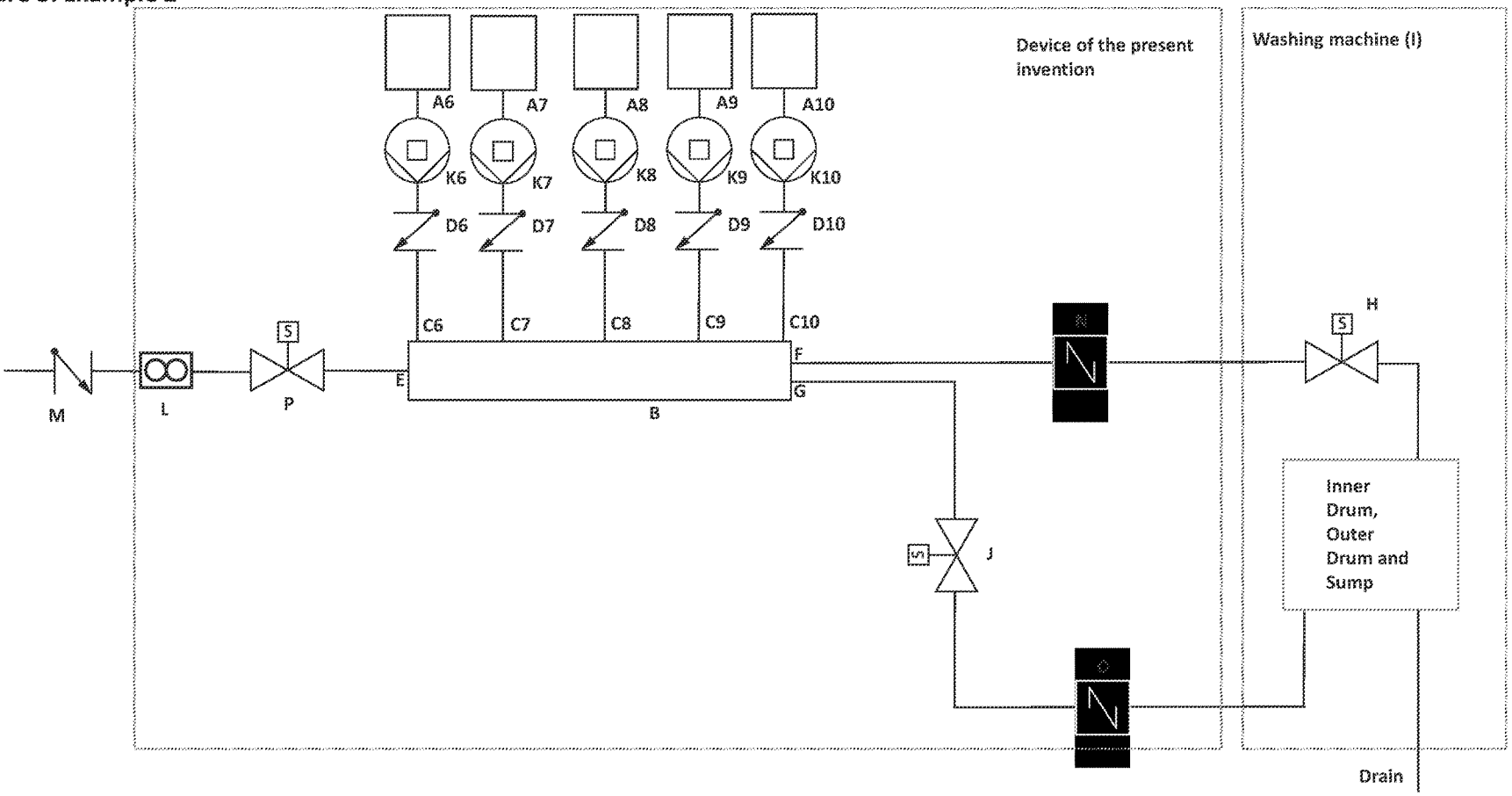
Figure 3: Example 2

DEVICE FOR DOSING A DETERGENT INGREDIENT INTO THE DRUM OF AN AUTOMATIC WASHING MACHINE

FIELD OF THE INVENTION

The present disclosure provides a device for dosing a detergent ingredient into the drum of an automatic washing machine. Specifically, the design enables automated delivery of detergent ingredients at multiple times through the washing process to either/both of the machine's water inlet and directly to the drum; in a way that significant washing performance benefits can be achieved due to the controlled variation of in-wash chemistry.

BACKGROUND OF THE INVENTION

Many forms of laundry detergent are commercially available to meet different performance needs during washing. Additionally, many types of laundry additive are available: including softeners, fragrance boosters and stain removal boosters. However, these can typically only be delivered at one of two or three times during the washing process (wash, final rinse, and pre-wash).

Furthermore, when water enters the washing machine and contacts with stains on laundry items it may not contain any detergent. This initial wetting will reduce the speed at which detergent chemistry is able to access fabrics after this point once it has entered the drum.

The present disclosure enables automated delivery of detergent ingredients at multiple times through the washing process to either/both of the machine's water inlet and directly to the drum; in a way that significant washing performance benefits can be achieved due to the controlled variation of in-wash chemistry.

SUMMARY OF THE INVENTION

The present disclosure provides a device for dosing a detergent ingredient into the drum of an automatic washing machine, wherein the device comprises:

(a) a reservoir (A) that comprises one or more detergent ingredients, wherein the reservoir feeds detergent ingredients into a dosing manifold (B) via a second inlet (C);

(b) a one-way valve (D) located downstream of the reservoir (A) and upstream of the second inlet (C), wherein the valve (D) prevents the flow of water from the dosing manifold (B) into the reservoir (A);

(c) a dosing manifold (B), wherein the dosing manifold (B) is connected to:
(i) a first inlet (E);
(ii) a second inlet (C);
(iii) a first outlet (F); and
(iv) a second outlet (G);

(d) a first inlet (E) that introduces water from a main water source into the dosing manifold (B);

(e) a second inlet (C) that introduces the detergent ingredients from the reservoir (A) into the dosing manifold (B) such that an aqueous detergent solution is formed in the dosing manifold (B);

(f) a first outlet (F) that feeds the aqueous detergent solution from the dosing manifold (B) to the drum of the automatic washing machine via the main inlet valve (H) of the automatic washing machine (I), so that the dose through the first outlet (F) into the drum is controlled by the automatic washing machine (I);

(g) a second outlet (G) that feeds the aqueous detergent solution from the dosing manifold (B) to the drum of the automatic washing machine (I) via a device valve (J), so that the main inlet valve (H) of the automatic washing machine is by-passed and the dose through the second outlet (G) into the drum is controlled by the device;

(h) a device valve (J) located downstream of the second outlet (G);

(i) a controller that controls the pump (K) and the device valve (J), wherein the controller controls the dose of the detergent ingredients into the dosing manifold (B), and wherein the controller controls the release of the aqueous detergent solution from the dosing manifold (B) via the second outlet (G);

(j) a pump (K) located downstream of the reservoir (A) and upstream of the second inlet (C), wherein the pump (K) doses the detergent ingredients into the dosing manifold (B); and (k) a flow meter (L) that sends a signal to the controller to inform the controller what the flowrate is through the dosing manifold (B).

BRIEF DESCRIPTION OF THE DRAWINGS

FIG. 2 shows a multi-reservoir device embodiment and illustrates: reservoirs (A1-A5); the dosing manifold (B); second inlets (C1-C5); one-way valves (D1-D5); the first inlet (E); the first outlet (F); the second outlet (G); the main inlet valve (H) of the automatic washing machine; the automatic washing machine (I); valve (J); pumps (K1-K5); the flow meter (L); the one-way valve (M); the mixing elements (N); and the mixing elements (O).

FIG. 3 shows a multi-reservoir device embodiment and illustrates: reservoirs (A6-A10); the dosing manifold (B); second inlets (C6-C10); one-way valves (D6-D10); the first inlet (E); the first outlet (F); the second outlet (G); the main inlet valve (H) of the automatic washing machine; the automatic washing machine (I); valve (J); the upstream valve (P); pumps (K6-K10); the flow meter (L); the one-way valve (M); the mixing elements (N); and the mixing elements (O).

DETAILED DESCRIPTION OF THE INVENTION

Figure 1:
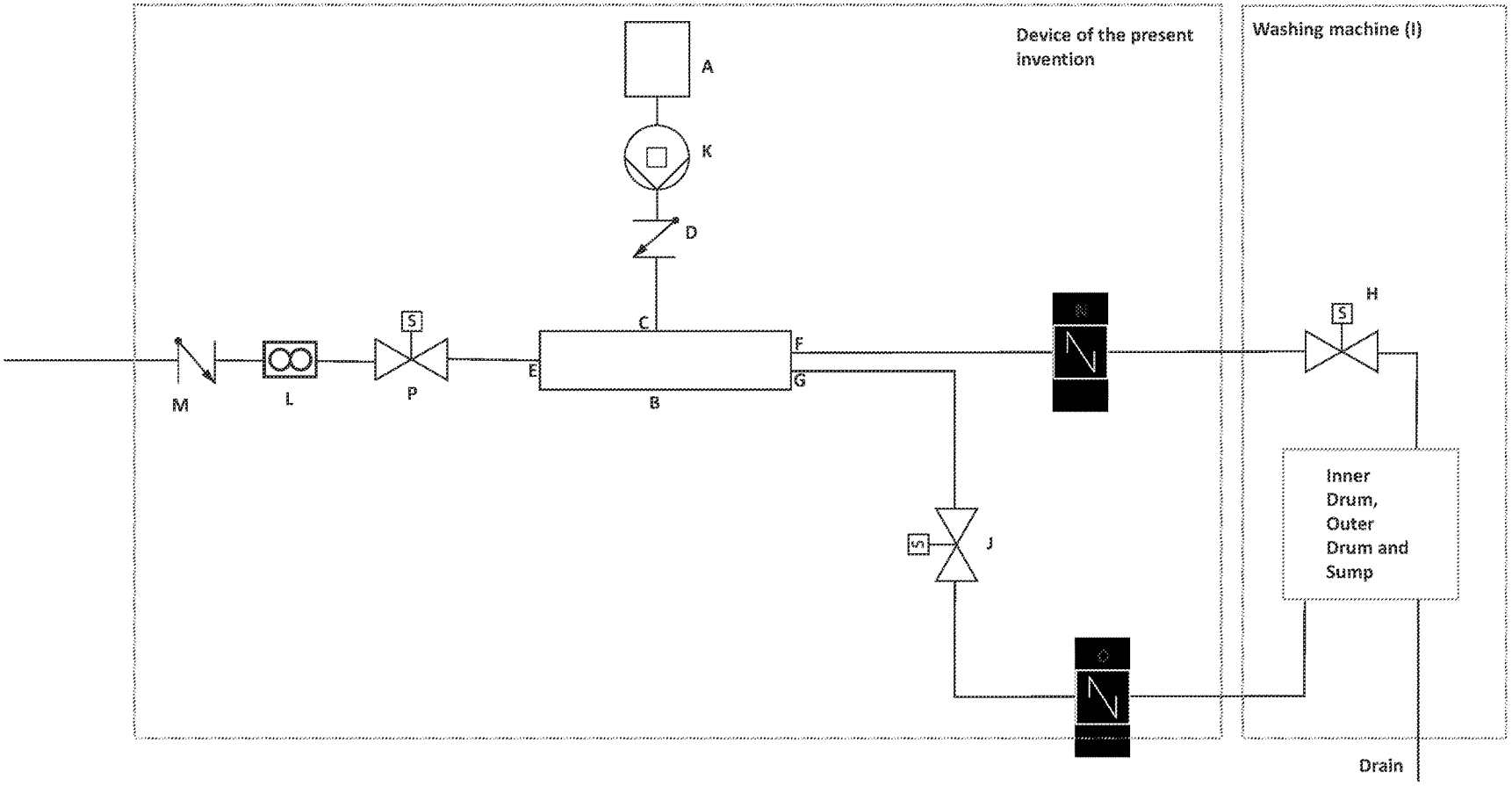
FIG. 1 shows the device and illustrates: the reservoir (A); the dosing manifold (B); the second inlet (C); the one-way valve (D); the first inlet (E); the first outlet (F); the second outlet (G); the main inlet valve (H) of the automatic washing machine; the automatic washing machine (I); valve (J); upstream valve (P); the pump (K); the flow meter (L); the one-way valve (M); the mixing elements (N); and the mixing elements (O).

Device for dosing a detergent ingredient into the drum of an automatic washing machine.

The device for dosing a detergent ingredient into the drum of an automatic washing machine comprises:

(a) a reservoir (A) that comprises one or more detergent ingredients, wherein the reservoir feeds detergent ingredients into a dosing manifold (B) via a second inlet (C);

(b) a one-way valve (D) located downstream of the reservoir (A) and upstream of the second inlet (C), wherein the valve (D) prevents the flow of water from the dosing manifold (B) into the reservoir (A);

(c) a dosing manifold (B), wherein the dosing manifold (B) is connected to:
(i) a first inlet (E);
(ii) a second inlet (C);
(iii) a first outlet (F); and
(iv) a second outlet (G);
(d) a first inlet (E) that introduces water from a main water source into the dosing manifold (B);
(e) a second inlet (C) that introduces the detergent ingredients from the reservoir (A) into the dosing manifold (B) such that an aqueous detergent solution is formed in the dosing manifold (B);
(f) a first outlet (F) that feeds the aqueous detergent solution from the dosing manifold (B) to the drum of the automatic washing machine via the main inlet valve (H) of the automatic washing machine (I), so that the dose through the first outlet (F) into the drum is controlled by the automatic washing machine (I);
(g) a second outlet (G) that feeds the aqueous detergent solution from the dosing manifold (B) to the drum of the automatic washing machine (I) via a device valve (J), so that the main inlet valve (H) of the automatic washing machine is by-passed and the dose through the second outlet (G) into the drum is controlled by the device;
(h) a device valve (J) located downstream of the second outlet (G);
(i) a controller that controls the pump (K) and the device valve (J), wherein the controller controls the dose of the detergent ingredients into the dosing manifold (B), and wherein the controller controls the release of the aqueous detergent solution from the dosing manifold (B) via the second outlet (G);
(j) a pump (K) located downstream of the reservoir (A) and upstream of the second inlet (C), wherein the pump (K) doses the detergent ingredients into the dosing manifold (B); and
(k) a flow meter (L) that sends a signal to the controller to inform the controller what the flowrate is through the dosing manifold (B).

The device may comprise a one-way valve (M) located upstream of the first inlet (E). This one-way valve (M) can prevent the flow of detergent aqueous solution formed in the manifold (B) into the main water source. In this manner, any contamination from the manifold into the main water source is prevented.

The device may comprise mixing elements (N) that are located downstream of the first outlet (F). These mixing elements (N) can mix the aqueous detergent solution as it flows towards the main inlet valve (H) of the washing machine.

The device may comprise mixing elements (O) that are located downstream of the second outlet (G). These mixing elements (O) can mix the aqueous detergent solution as it flows towards the drum of the washing machine.

The device may comprise one or more additional reservoirs (A). These additional reservoirs are capable of dosing different detergent ingredients into the dosing manifold (B). The device may comprise one or more, two or more, three or more, four or more, five or more, or even six or more additional reservoirs. The device may comprise from two or more to six or more additional reservoirs. Preferably, the device comprises four additional reservoirs. Having additional reservoirs means different detergent ingredients can be separated into different reservoirs. For example, bleach ingredients could be present in one reservoir, whilst perfume and/or enzymes (or other bleach sensitive ingredients) can be present in a different reservoir. For example, a preferred configuration comprises five reservoirs with the following ingredients: 1) detergent composition; 2) basic solution, such as 50% caustic, 3) acidic solution, such as 50% citric acid; 4) perfume solution; 5) softener solution. Reservoirs 2 and 3 are used to enable the control of pH through the washing process. Another option comprises: 1) a first detergent composition; 2) a second detergent solution; 3) bleach composition; 4) perfume solution; 5) softener solution. Another preferred configuration comprises three reservoirs with the following ingredients: 1) detergent composition; 2) perfume solution; c) softener solution.

Reservoir (A).

The reservoir (A) comprises one or more detergent ingredients. The reservoir feeds detergent ingredients into a dosing manifold (B) via a second inlet (C).

One-Way Valve (D).

The one-way valve (D) is located downstream of the reservoir (A) and upstream of the second inlet (C). The valve (D) prevents the flow of water from the dosing manifold (B) into the reservoir (A).

The one-way valve (D) may also be located downstream of the pump (K). In this manner, the one-way valve (D) can prevent the flow of water from the dosing manifold (B) to the pump (K).

By limiting the dilution of the detergent composition in the inlet (C), pump (K) or reservoir (A), the controller can more accurately control the dosing of detergent ingredients into the dosing manifold. By locating the one-way valve (D) as close to the dosing manifold (B) as possible, the lag time between pumping and detergent reaching the manifold is minimized.

Dosing Manifold (B).

The dosing manifold (B) is connected to:
(i) a first inlet (E);
(ii) a second inlet (C);
(iii) a first outlet (F); and
(iv) a second outlet (G).

First Inlet (E).

The first inlet (E) introduces water from a main water source into the dosing manifold (B).

Second Inlet (C).

The second inlet (C) introduces the detergent ingredients from the reservoir (A) into the dosing manifold (B) such that an aqueous detergent solution is formed in the dosing manifold (B).

First Outlet (F).

The first outlet (F) feeds the aqueous detergent solution from the dosing manifold (B) to the drum of the automatic washing machine via the main inlet valve (H) of the automatic washing machine (I), so that the dose through the first outlet (F) into the drum is controlled by the automatic washing machine (I).

Second Outlet (G).

The second outlet (G) feeds the aqueous detergent solution from the dosing manifold (B) to the drum of the automatic washing machine (I) via a device valve (J), so that the main inlet valve (H) of the automatic washing machine is by-passed and the dose through the second outlet (G) into the drum is controlled by the device.

Device Valve (J).

The device valve (J) is located downstream of the second outlet (G).

Controller.

The controller controls the pump (K) and the device valve (J). The controller controls the dose of the detergent ingredients into the dosing manifold (B). The controller also controls the release of the aqueous detergent solution from the dosing manifold (B) via the second outlet (G).

Pump (K).

The pump (K) is located downstream of the reservoir (A) and upstream of the second inlet (C). The pump (K) doses the detergent ingredients into the dosing manifold (B).

It may be preferred that the pump (K) is a gear pump. The gear pump is the preferred approach when dosing detergent ingredients via the second outlet (G) during the washing process because of its low cost, ease of control, and the ability to deliver high flows. In this case, the option to dose detergent ingredients into an atmospheric manifold eliminates the flowrate variability that would exist as a function of the water line pressure.

It may be preferred that the pump (K) is a syringe pump. A syringe pump is the preferred pump when dosing detergent ingredients via the first outlet (F) while the water fills the washing machine (I). This pump allows for a very precise control of the detergent ingredient flowrate irrespective of the water line pressure or changes in viscosity of the detergent solution as a function of temperature or time.

Such a syringe pump may comprise a syringe attached to a controlled linear actuator, whereby the syringe is connected via an infeed tube and one-way valve to the reservoir and an outfeed tube and one-way valve to the dosing manifold, such that a forward motion of the syringe piston allows dosing into the dosing manifold without flow to the reservoir, and a reverse motion of the syringe piston allows refilling from the reservoir without flow from the dosing manifold. A linear actuator may comprise a controller, position sensors, motor, gear system, rack and pinion.

Flow Meter (L).

The flow meter (L) sends a signal to the controller to inform the controller what the flowrate is through the dosing manifold (B).

The controller typically controls what the flowrate is through the dosing manifold (B).

Method of Laundering.

The method of laundering uses the device of the present disclosure.

Preferably, during the method the controller controls the dose of detergent ingredients into the dosing manifold (B) to ensure that amount of detergent ingredients dosed into the dosing manifold (B) is the in range from 20 mg per litre of water dispensed into the washing machine drum to 7000 mg per litre of water dispensed into the washing machine drum, and wherein the aqueous detergent solution that is formed in the dosing manifold is then fed to the drum of the automatic washing machine via the second outlet.

This dosing approach allows to quickly add an amount of a specific detergent ingredient available in one of the reservoirs any time during washing process once the main wash water fill has been measured with the flowmeter (L). For example, this approach can be used to control the pH of the wash solution by addition of a basic or acidic solution once the process of washing is undergoing. It is also the preferable method for dosing reservoir solutions that need to be added in very small amounts in relation to the volume of wash water, where the liquid flowrate required from the reservoir to maintain a continuous water/reservoir solution flowrate ratio would be too low. For example, the addition of small doses of perfume.

It may also be preferred that during the method the controller controls the dose of detergent ingredients into the dosing manifold (B) to ensure that the ratio of: (i) the flow rate of detergent ingredients into the dosing manifold (B); to (ii) flow rate of water through the dosing manifold (B), is in the range of from 0.0005:1 to 0.005:1 L/L, and wherein the aqueous detergent solution formed in the dosing manifold (B) is fed to the drum of the automatic washing machine (I) via the first outlet (F).

This dosing approach is the preferred approach to dispense detergent ingredients that need to be dissolved/dispersed and mixed with the full volume of wash water before this water contacts the fabrics. By doing so, the dispensed chemistry can quickly reach the internal structure of the fabrics to enable larger cleaning benefits and shorter washing times. This is the preferred approach for the dosing of the main detergent solution during the water fill of the main wash or the dosing of the softener solution during the water fill of the final rinse.

It may be preferred that during the method, the device valve (J) is opened prior to the pump (K) dosing detergent ingredients into the dosing manifold (B). This is usually necessary when the detergent ingredients need to be delivered via the manifold second outlet. The valve (J) opens prior to the pump (K) dosing detergent ingredients into the dosing manifold (B) to allow for the dosing of an incompressible fluid.

It may be preferred that the device comprises a valve (P) that is located upstream of the first inlet (E). Valve (P) is typically a usually-open valve. It may also be preferred that during the method:

(i) this valve (P) is closed to prevent flow of water into the dosing manifold (B) prior to dosing detergent ingredients into the dosing manifold (B);

(ii) detergent ingredients are then dosed into the dosing manifold (B) whilst the valve (P) is closed and valve (J) is open; and (iii) after the detergent ingredients are dosed into the dosing manifold (B), the valve (P) is opened and valve (J) is closed after a time delay.

This sequence allows to dose detergent ingredients into the dosing manifold (B) at atmospheric pressure so that the pump (K), especially when using a gear pump, can deliver a precise dose irrespective of the available pressure in the water line without the need for using pump flowrate correction factors as a function of water line pressure. The time delay after the opening of valve (P) before closing valve (J) is to enable the chemistry solution in the dosing manifold (B) to flow to the washing machine (I).

EXAMPLES

In Example 1, described in FIG. 2, five different compositions can be delivered to the dosing manifold;

Cartridge 1: a core detergent (described in table 1 below) can be dosed using a syringe pump to the dosing manifold via a one-way valve;

Cartridge 2: aqueous 50% sodium hydroxide solution can be dosed using a gear pump to the dosing manifold via a one-way valve;

Cartridge 3: aqueous 50% citric acid solution can be dosed using a gear pump to the dosing manifold via a one-way valve;

Cartridge 4: a perfume composition (described in table 2 below) can be dosed using a gear pump to the dosing manifold via a one-way valve;

Cartridge 5: A fabric softening composition, containing 7% of a methyldiethanol amine based esterquat, can be dosed using a syringe pump to the dosing manifold via a one-way valve.

When a significant flow of water is detected through the inlet flowmeter (L), a controller activates the first syringe pump such that core detergent is dosed to the manifold in a ratio of 2.6 ml of detergent per litre of water. This is stopped when the controller senses a cessation of flow through the flowmeter once a set time has elapsed.

After 2 minutes have elapsed after sensing of initial water flow, the controller opens valve (J) and activates the first gear pump such that 9 ml of 50% sodium hydroxide solution is delivered to the dosing manifold, and in turn, to the automatic washing machine. This increases the pH of the wash solution in the washing machine drum. After a delay, valve (J) is closed.

After a further 8 minutes have elapsed after sensing of initial water flow, the controller opens valve (J) and activates the second gear pump such that 12.1 ml of 50% citric acid solution is delivered to the dosing manifold, and in turn, to the automatic washing machine. This decreases the pH of the wash solution in the washing machine drum. After a delay, valve (J) is closed.

The controller then waits until a significant (>0.5 litre) delivery of water is detected by the flowmeter, registering this as a first rinse event. After waiting a further 5 minutes, the controller waits again for a further significant delivery of water to be detected by the flowmeter. At this point, a second rinse event is registered and the second syringe pump is activated such that fabric softening composition is dosed into the dosing manifold at a ratio of 2.3 ml per litre of water until a cessation of flow is sensed. Valve (J) is opened for 5 seconds to enable flushing through of the dosing manifold to the machine.

Valve (J) is then opened again and the third gear pump activated such that 5 ml of the perfume composition is dosed to the dosing manifold. Valve (J) remains open for a further 5 seconds.

Valve (J) is then opened again and the second gear pump activated such that 4.4 ml of 50% citric acid solution is delivered to the dosing manifold. Valve (J) remains open for a further 5 seconds.

TABLE 1

Composition of cartridge 1 in example 1.

| | material | level active, % |
|---|---|---|
| Surfactants | Sodium dodecyl benzenesulfonate (LAS) | 12.58 |
| | C14-15 AA with 7 EO | 6.39 |
| | C12-14 AES with 3 EO (70%) | 9.65 |
| | Lauramine oxide | 0.98 |
| Builders/Chelant | Fatty Acids | 2.93 |
| | Citric Acid | 3.69 |
| | Diethylene triamine penta(methyl phosphonic acid) (DTPMP) | 1.54 |
| Performance actives/ preservatives | Polymer Lutensit Z96 | 1.01 |
| | Polyethylene glycol (PEG)—co-polyvinyl acetate (PvAc) | 1.50 |
| | Texcare SRN 260 soil release polymer | 3.74 |
| | Brighteners | 0.1120 |
| | Hueying dye | 0.0014 |
| | Preservatives | 0.0035 |
| Enzymes/ stabilisers | Protease | 0.13 |
| | Amylase | 0.0060 |
| | Lipase | 0.0255 |
| | Na Formate (40% solution) | 1.83 |
| Solvent/ neutralizer/ structurant | Ethanol | 0.67 |
| | 1,2 Propylene glycol | 6.70 |
| | NaOH | 7.19 |
| | MEA hydrogenated castor oil | 0.53 |

TABLE 2

Perfume composition.

| Material | Level active, % |
|---|---|
| Perfume oil | 31.73 |
| Perfume microcapsules slurry | 17.51 |
| Sodium dodecyl benzenesulfonate (LAS) | 2.54 |
| Water | 48.22 |

In Example 2, described in FIG. 3, five different compositions can be delivered to the dosing manifold;

Cartridge 1: a core detergent (described in table 1 above) can be dosed using a syringe pump to the dosing manifold via a one-way valve;

Cartridge 2: a peracid based bleach composition (17% active) can be dosed using a peristaltic pump to the dosing manifold via a one-way valve;

Cartridge 3: a first perfume composition (described in table 2 above) can be dosed using a peristaltic pump to the dosing manifold via a one-way valve;

Cartridge 4: a second perfume composition (described in table 3 below) can be dosed using a peristaltic pump to the dosing manifold via a one-way valve;

Cartridge 5: A fabric softening composition, containing 7% of a methyldiethanol amine based esterquat can be dosed using a syringe pump to the dosing manifold via a one-way valve.

An upstream valve (P) is normally open. When a significant flow of water is detected through the inlet flowmeter (L), a controller activates the first syringe pump such that the core detergent is dosed to the manifold in a ratio of 2.6 ml of detergent per litre of water. The syringe pump is stopped when the controller senses a cessation of flow through the flowmeter, once a set time has elapsed.

After 7 minutes have elapsed after sensing of initial water flow, the controller closes the upstream valve (P) and opens the valve (J). It then activates the first peristaltic pump such that 30 ml of peracid-based bleach solution is delivered to the dosing manifold. After pumping ceases, the upstream valve (P) is opened to allow flushing through of the dosing manifold with water and delivery of chemistry to the washing machine. Valve (J) remains open for a further 5 seconds.

The controller then waits until both a minimum of 12 minutes have elapsed and a significant (>0.5 litre) delivery of water is detected by the flowmeter, registering this as a first rinse event. After waiting a further 5 minutes, the controller waits again for a further significant delivery of water to be detected by the flowmeter. At this point, a second rinse event is registered and the second syringe pump is activated such that fabric softening composition is dosed into the dosing manifold at a ratio of 2.3 ml/L until a cessation of flow is sensed, once a set time has elapsed. Valve (J) is opened for 5 seconds to enable flushing through of the dosing manifold to the machine.

The upstream valve (P) is then closed and valve (J) is then opened again and either the second or third peristaltic pumps activated such that 3 ml of a perfume composition is dosed to the dosing manifold. After pumping ceases, the upstream device valve (P) is opened to allow flushing through of the dosing manifold with water and delivery of chemistry to the washing machine. Valve (J) remains open for a further 5 seconds.

TABLE 3

| Perfume composition 2. | |
|---|---|
| Material | Level active, % |
| Perfume oil | 20 |
| Perfume microcapsules slurry | 29.24 |
| Sodium dodecyl benzenesulfonate (LAS) | 2.54 |
| Water | 48.22 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A device for dosing a detergent ingredient into the drum of an automatic washing machine, wherein the device comprises:

(a) a reservoir that comprises one or more detergent ingredients, wherein the reservoir feeds detergent ingredients into a dosing manifold via a second inlet;

(b) a one-way valve located downstream of the reservoir and upstream of the second inlet, wherein the valve prevents the flow of water from the dosing manifold (B) into the reservoir;

(c) the dosing manifold, wherein the dosing manifold is connected to:

(i) a first inlet;

(ii) the second inlet;

(iii) a first outlet; and (iv) a second outlet;

(d) the first inlet, wherein the first inlet introduces water from a main water source into the dosing manifold;

(e) the second inlet, wherein the second inlet introduces a dose of the detergent ingredients from the reservoir into the dosing manifold such that an aqueous detergent solution is formed in the dosing manifold;

(f) a first outlet that feeds the aqueous detergent solution from the dosing manifold to the drum of the automatic washing machine via a main inlet valve of the automatic washing machine, so that a dose of the aqueous detergent solution fed through the first outlet into the drum is controlled by the automatic washing machine;

(g) the second outlet, wherein the second outlet feeds the aqueous detergent solution from the dosing manifold to the drum of the automatic washing machine via a device valve, so that the main inlet valve of the automatic washing machine is by-passed and a dose of the aqueous detergent solution fed through the second outlet into the drum is controlled by the device;

(h) the device valve, wherein the device valve is located downstream of the second outlet;

(i) a controller that controls a pump and the device valve, wherein the controller controls the dose of the detergent ingredients into the dosing manifold, and wherein the controller controls the release of the aqueous detergent solution from the dosing manifold via the second outlet;

(j) the pump, wherein the pump is located downstream of the reservoir and upstream of the second inlet and doses the detergent ingredients into the dosing manifold; and (k) a flow meter that sends a signal to the controller to inform the controller what a flowrate is through the dosing manifold.

2. A device according to claim 1, wherein the device comprises a one-way valve located upstream of the first inlet, wherein the one-way valve prevents the flow of detergent aqueous solution formed in the manifold into the main water source.

3. A device according to claim 1, wherein the one-way valve is also located downstream of the pump, wherein the one-way valve prevents the flow of water from the dosing manifold to the pump.

4. A device according to claim 1, wherein mixing elements are located downstream of the first outlet, wherein the mixing elements mix the aqueous detergent solution as it flows towards the main inlet valve of the washing machine.

5. A device according to claim 1, wherein mixing elements are located downstream of the second outlet, wherein the mixing elements mix the aqueous detergent solution as it flows towards the drum of the washing machine.

6. A device according to claim 1, wherein the device comprises one or more additional reservoirs, and wherein the additional reservoirs are capable of dosing different detergent ingredients into the dosing manifold.

7. A method of laundering using the device according to claim 1.

8. A method according to claim 7, wherein the controller controls the dose of detergent ingredients into the dosing manifold to ensure that amount of detergent ingredients dosed into the dosing manifold is the in range of from 20 mg per litre of water dispensed into the washing machine drum to 3500 mg per litre of water dispensed into the washing machine drum, and wherein the aqueous detergent solution that is formed in the dosing manifold is then fed to the drum of the automatic washing machine via the second outlet.

9. A method according to claim 7, wherein the controller controls the dose of detergent ingredients into the dosing manifold to ensure that the ratio of:

(i) the flow rate of detergent ingredients into the dosing manifold; to (ii) flow rate of water through the dosing manifold, is in the range of from 0.0005:1 to 0.005:1 L/L, and wherein the aqueous detergent solution formed in the dosing manifold is fed to the drum of the automatic washing machine via the first outlet.

10. A method according to claim 7, wherein the device valve is opened prior to the pump dosing detergent ingredients into the dosing manifold.

11. A method according to 7, wherein the device comprises a valve located upstream of the first inlet, and wherein:

(i) this valve is closed to prevent flow of water into the dosing manifold prior to dosing detergent ingredients into the dosing manifold;

(ii) detergent ingredients are then dosed into the dosing manifold whilst the valve is closed; and (iii) after the detergent ingredients are dosed into the dosing manifold, the valve is opened.

12. A method according to claim 7, wherein the pump is a gear pump.

13. A method according to claim 7, wherein the pump is a syringe pump.

* * * * *